US006295191B1

(12) United States Patent
Kishida et al.

(10) Patent No.: US 6,295,191 B1
(45) Date of Patent: Sep. 25, 2001

(54) SWITCHING APPARATUS

(75) Inventors: Yukimori Kishida; Kazuhiko Kagawa; Hiroyuki Sasao; Chie Takahashi; Toshie Takeuchi; Hiroyuki Akita; Eiji Moritoh, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/360,690

(22) Filed: Jul. 26, 1999

(30) Foreign Application Priority Data

Jul. 27, 1998 (JP) ..... 10-211333

(51) Int. Cl.[7] ..... H01H 47/00
(52) U.S. Cl. ..... 361/139; 361/160
(58) Field of Search ..... 361/152–156, 361/160, 139

(56) References Cited

U.S. PATENT DOCUMENTS 4,086,645 4/1978 Gorman et al. .

6,046,423 * 4/2000 Kishida et al. ..... 218/154

OTHER PUBLICATIONS

Y. Kishida, et al.; "Development of the High Speed Switch and Its Application", Conference Record of the 1998 IEEE–IAS Annual Meeting, pp. 2321–2328.

* cited by examiner

*Primary Examiner*—Fritz Fleming
(74) *Attorney, Agent, or Firm*—Leydig, Voit & Mayer, Ltd.

(57) ABSTRACT

A switching apparatus includes a switch, a movable coil, stationary coil members, and a direction-of-conduction setter comprising diodes. The switch has a stationary electrode. The movable coil is fixedly mounted on a movable shaft coupled to the movable electrode. The stationary coil members are opposed to the movable coil. The power supply supplies an excitation current to the coils. The direction-of-conduction setter sets the direction of conduction, in which the excitation current flows from the power supply into the coils, so that the coils will electromagnetically react on each other. This arrangement provides highly efficient electromagnetic driving. Moreover, an opening power supply or closing power supply is required to have only a small capacity.

7 Claims, 9 Drawing Sheets

OPEN STATE
CLOSED STATE
1
5
6
7
3a
3b
10
S
4
8a
8b
9

OPEN STATE

CLOSED STATE

OPEN STATE

CLOSED STATE

SWITCHING APPARATUS

BACKGROUND OF THE INVENTION

1. Field of the Invention

The present invention relates to a switching apparatus having electrodes which can be placed into and out of contact with each other for opening and closing a pair of electrodes, and more particularly, it relates to improving the efficiency in driving a switching apparatus with electromagnetic repulsion.

2. Description of the Related Art

FIGS. 8(*a*) and 8(*b*) show something analogous to a conventional switching apparatus utilizing electromagnetic repulsion which is, for example, described in speech No. 260 entitled "Switching Characteristic of Novel High-Speed Switch." The speech was made at the Japanese National Convention of the Department of Industrial Application of the Electric Society at the year of 1996.

In FIGS. 8(*a*) and 8(*b*), a switching apparatus includes a switch 1 having a movable electrode 5 and a stationary electrode 6 which can be placed into and out of contact with each other, a repulsion unit 2, an opening coil 3*a* for inducing current in the repulsion unit 2, a closing coil 3*b* for inducing a current in the repulsion unit 2, a movable shaft 4 coupled to the movable electrode 5, a terminal 7 connected to the movable electrode 5 and the stationary electrode 6, a pair of pressurizing springs 8*a*, 8*b* for urging the movable electrode 5 in a direction to contact the stationary electrode 6 through the movable shaft 4, and an auxiliary switch 9 operably connected with the switch 1 through the movable shaft 4. The repulsion unit 2 and the movable electrode 5 are fixedly coupled to the movable shaft 4, and disposed in a concentric relation to the electrodes. The opening coil 3*a* and the closing coil 3*b* are connected to a current supply (not shown) for generating magnetic fields. Moreover, the movable shaft 4 passes through a support member S for sliding movement relative thereto. The support member S supports the opening coil 3*a* and the closing coil 3*b* in opposition to each other with the repulsion unit 2 disposed therebetween.

In this connection, note that FIG. 8(*a*) shows a closed state of the movable and stationary coils 6*a*, 6*b*, while FIG. 8(*b*) shows an open state of them.

Moreover, FIG. 9 shows the load characteristics of the pressurizing springs 8*a* and 8*b* and a combined load thereof. Reference numeral 40 denotes the load characteristic of the pressurizing spring 8*a*, and 41 denotes the load characteristics of the pressurizing spring 8*b*. Reference numeral 42 denotes the combined load of the pressurizing springs 8*a* and 8*b*.

The pressurizing springs 8*a* and 8*b* are so arranged as to generate a combined load 42. Specifically, as shown in FIG. 9, the pressurizing springs 8*a* and 8*b* generate a load in a direction to close the movable and stationary contacts 5, 6 of the switch 1 within a range of deflection from an intermediate position to a closed position of the combined load. Another load will be generated in a direction to open the movable and stationary contacts 5, 6 of the switch within a range of deflection from the intermediate position to an open position of the combined load.

Next,an opening action for the switch 1 will be described. In a closed state of the switch 1 shown in FIG. 8(*a*), a pulsating current flows from the magnetic field generation current supply (not shown) into the opening coil 3*a*. This causes an induction current to flow into the repulsion unit 2, thereby inducing magnetic fields in a direction opposite magnetic fields generated by the opening coil 3*a*.

Due to the interaction between the magnetic fields induced by the opening coil 3*a* and the magnetic fields induced by the repulsion unit 2, the repulsion unit 2 undergoes electromagnetic repulsion to repulse the opening coil 3*a*.

Due to the electromagnetic repulsion, the movable shaft 4 and the movable electrode 5 fixed to the repulsion unit 2 together act in a direction of repulsion, so that In FIG. 9, the magnitude of deflection of the pressurizing spring 8*a* is changed from a value permitting the spring to lie at the closed position, to a value permitting the spring to lie at the intermediate position. With the change in the magnitude of deflection, the load characteristic 42 of the pressurizing spring 8*a* deteriorates. When the pressurizing spring 8*a* warps to go beyond the intermediate position, the load characteristic 42 provides a load oriented in a direction of opening. When the magnitude of warp assumes a value permitting the spring to lie at the open position, the switch 1 remains open as shown in FIG. 8(*b*).

Next, a closing action will be described. In an open state of the switch shown in FIG. 8(*b*), when a pulsating current flows into the closing coil 3*b*, magnetic fields are induced therein. This causes an induction current to flow into the repulsion unit 2. Thus, the repulsion unit 2 undergoes electromagnetic repulsion to repulse the closing coil 3*b*. Due to the electromagnetic repulsion, the movable shaft 4 and the movable electrode 5 fixed to the repulsion unit 2 act in the direction of repulsion. In FIG. 9, the magnitude of deflection of the pressurizing spring 8*b* changes from a value permitting the spring to lie at the closed position to a value permitting it to lie at the intermediate position. With the change in the magnitude of deflection, the load characteristic 42 improves. When the pressurizing spring 8*b* is deflected to go beyond the intermediate position, the load characteristic 42 provides a load oriented in a direction of closing. When the magnitude of deflection assumes a value permitting the spring to lie at the closed position, the switch 1 is closed as shown in FIG. 8(*a*).

In the conventional switching apparatus, as mentioned above, the magnetic field strength provided by the repulsion unit 2 due to induction is smaller than that provided by supplying current directly to an electric circuit. Consequently, electromagnetic repulsion stemming from the interaction between magnetic fields induced by a coil and those induced in the repulsion unit does not occur effectively. Moreover, in order to increase the magnetic field strength, the number of turns of the coil has to be increased, or pulsating current output has to be increased, thus requiring a large power supply. This poses a problem in that an entire device has to be designed on a large scale.

Moreover, in the conventional switching apparatus, high driving efficiency is realized by utilizing electromagnetic repulsion derived from the interaction between magnetic fields induced by the coils and those induced in the repulsion unit. When an opening or closing action is carried out, it becomes necessary for each coil to receive the supply of pulsating current from a power supply. This is disadvantageous in terms of costs and compactness of the device.

SUMMARY OF THE INVENTION

Accordingly, the present invention is intended to obviate the foregoing problems as encountered with the conventional switching apparatus, and has for its object to provide a novel and improved switching apparatus capable of suppressing energy required for switching and being designed compactly by reducing the size of a driving power supply.

Another object of the present invention is to provide a novel and improved switching apparatus which requires a reduced number of power supplies and hence can be produced and operated at reduced costs.

Bearing the above objects in mind, according to the present invention, there is provided a switching apparatus comprising: a switch unit having a stationary electrode and a movable electrode that is movable toward and away from the stationary electrode; a movable coil fixedly mounted on a movable shaft coupled to the movable electrode; a stationary coil disposed in opposition to the movable coil; a power supply for supplying an excitation current to the stationary and movable coils so as to move the movable coil toward or away from the stationary coil, thereby placing the movable electrode into or out of contact with the stationary electrode; and a direction-of-conduction setter for setting the direction of conduction in which the excitation current flows from the power supply to the stationary and movable coils, so that when the switch unit is opened or closed, magnetic fields induced by the stationary and movable coils will interact with each other.

In one preferred form of the invention, the stationary coil comprises a first stationary coil member and a second stationary coil member disposed in opposition to each other at a location above and below the movable coil. When the switch unit is opened to allow an excitation current to flow from the power supply into the movable coil and the first stationary coil member, the direction-of-conduction setter sets the direction of conduction in which the excitation current flows from the power supply into the movable coil and the first stationary coil, so that magnetic repulsion will occur between the movable coil and the first stationary coil member, whereas when the switch unit is closed to allow an excitation current to flow from the power supply into the movable coil and the second stationary coil member, the direction-of-conduction setter sets the direction of conduction in which the excitation current flows from the power supply into the movable coil and the second stationary coil member, so that magnetic repulsion will occur between the movable coil and the second stationary coil member.

In another preferred form of the invention, the switching apparatus further comprises: a first inhibiter for inhibiting the inflow of current to the second stationary coil member when the first stationary coil member and the movable coil are supplied with a current from the power supply; and a second inhibiter for inhibiting the inflow of current to the first stationary coil member when the second stationary coil member and the movable coil are supplied with a current from the power supply.

In a further preferred form of the invention, when the switch unit is opened to allow an excitation current to flow from the power supply into the stationary coil and the movable coil, the direction-of-conduction setter sets the direction of conduction, in which the excitation current flows from the power supply into the coils, so that magnetic repulsion will occur between the movable coil and the stationary coil, whereas when the switch unit is closed to allow an excitation current to flow into the movable coil and the stationary coil, the direction-of-conduction setter sets the direction of conduction, in which the excitation current flows from the power supply into the coils, so that magnetic attraction will occur between the movable coil and the stationary coil.

In a yet further preferred form of the invention, the stationary coil and the movable coil are covered with a magnetic substance.

The above and other objects, features and advantages of the present invention will be more readily apparent from the following detailed description of preferred embodiments of the invention when taken in conjunction with the accompanying drawings.

DESCRIPTION OF THE PREFERRED EMBODIMENTS

Now, preferred embodiments of the present invention will be described in detail while referring to the accompanying drawings.

First Embodiment

Figures 1A, 1B:
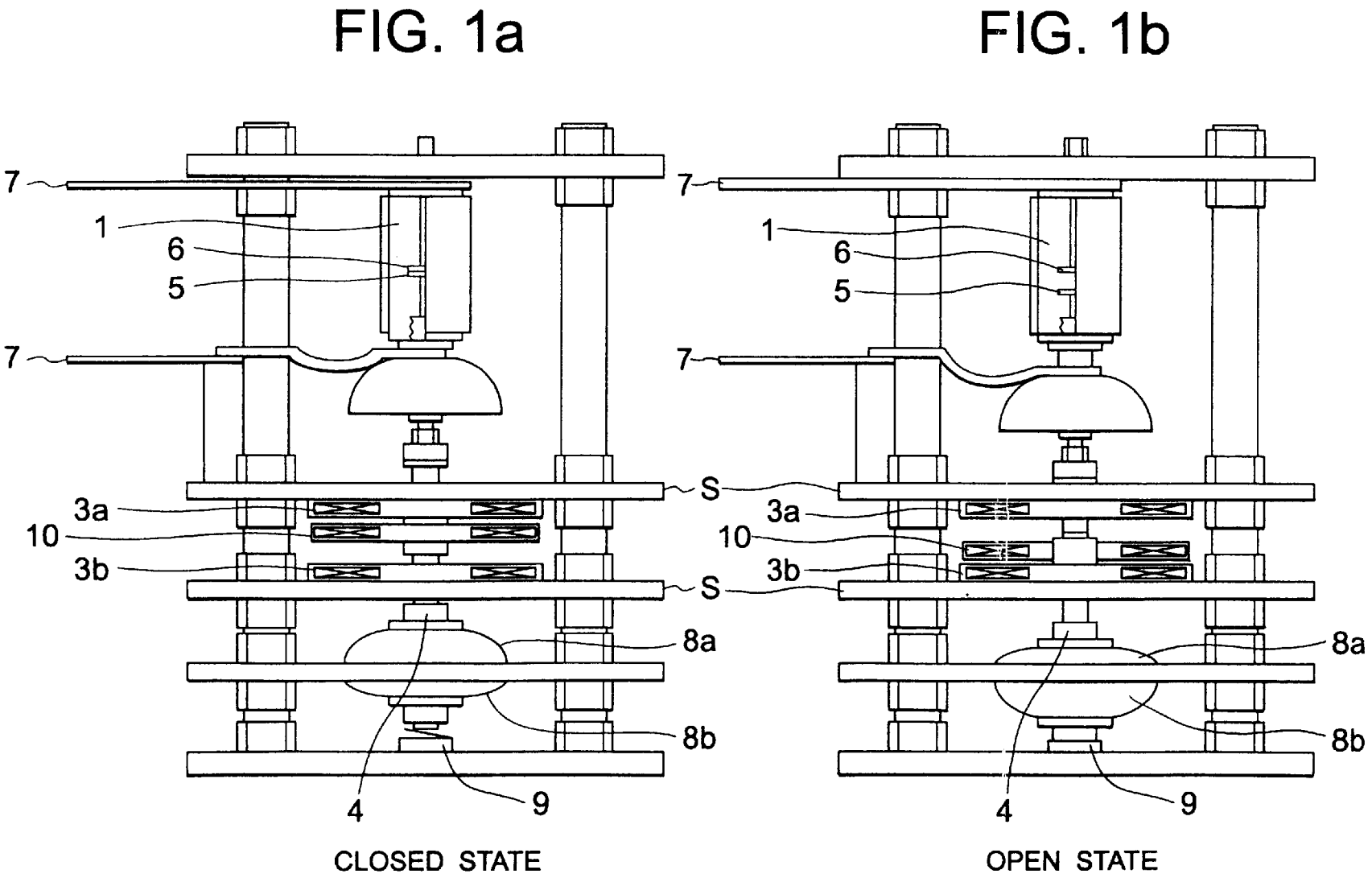
FIGS. 1(*a*) and 1(*b*) show the structure of a switching apparatus at its different operating states in accordance with a first embodiment of the present invention.
Figure 8B:
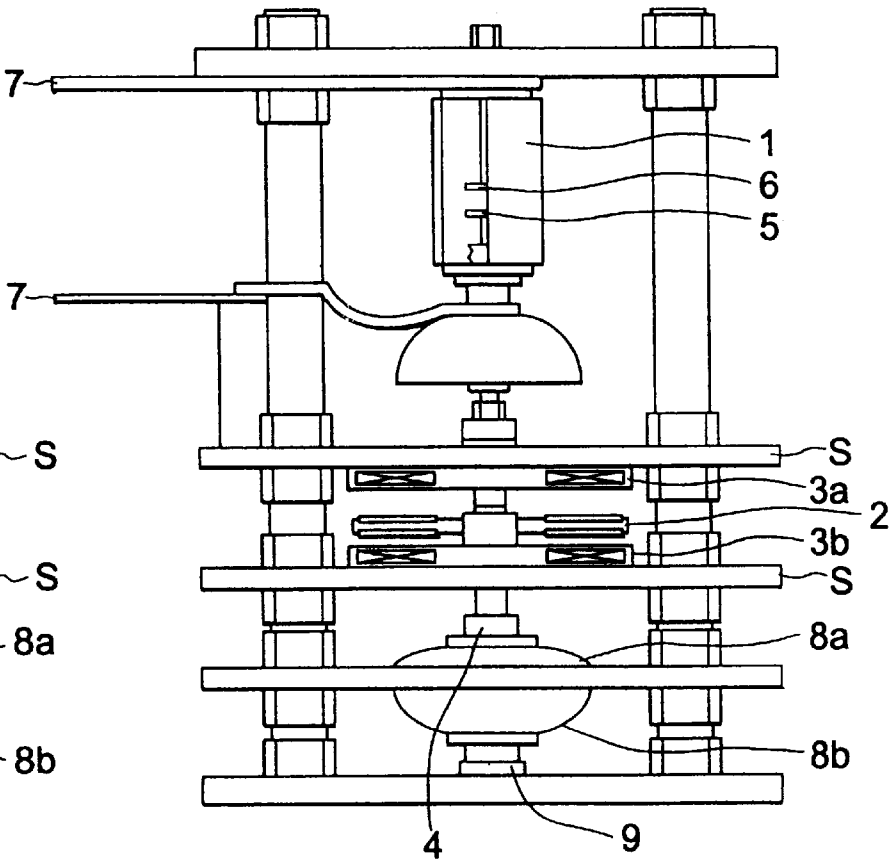
FIG. 8b PRIOR ART
FIGS. 8(*a*) and 8(*b*) show the structure of a conventional switching apparatus at its different operating states.
Figure 8A:
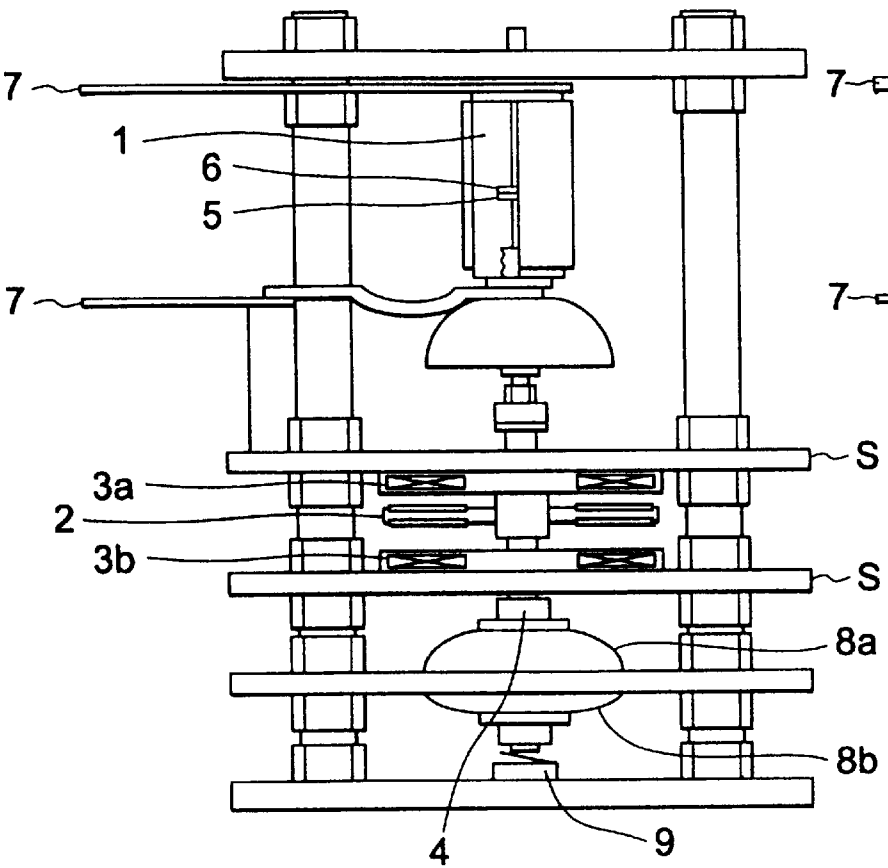
FIG. 8a PRIOR ART
Figure 9:
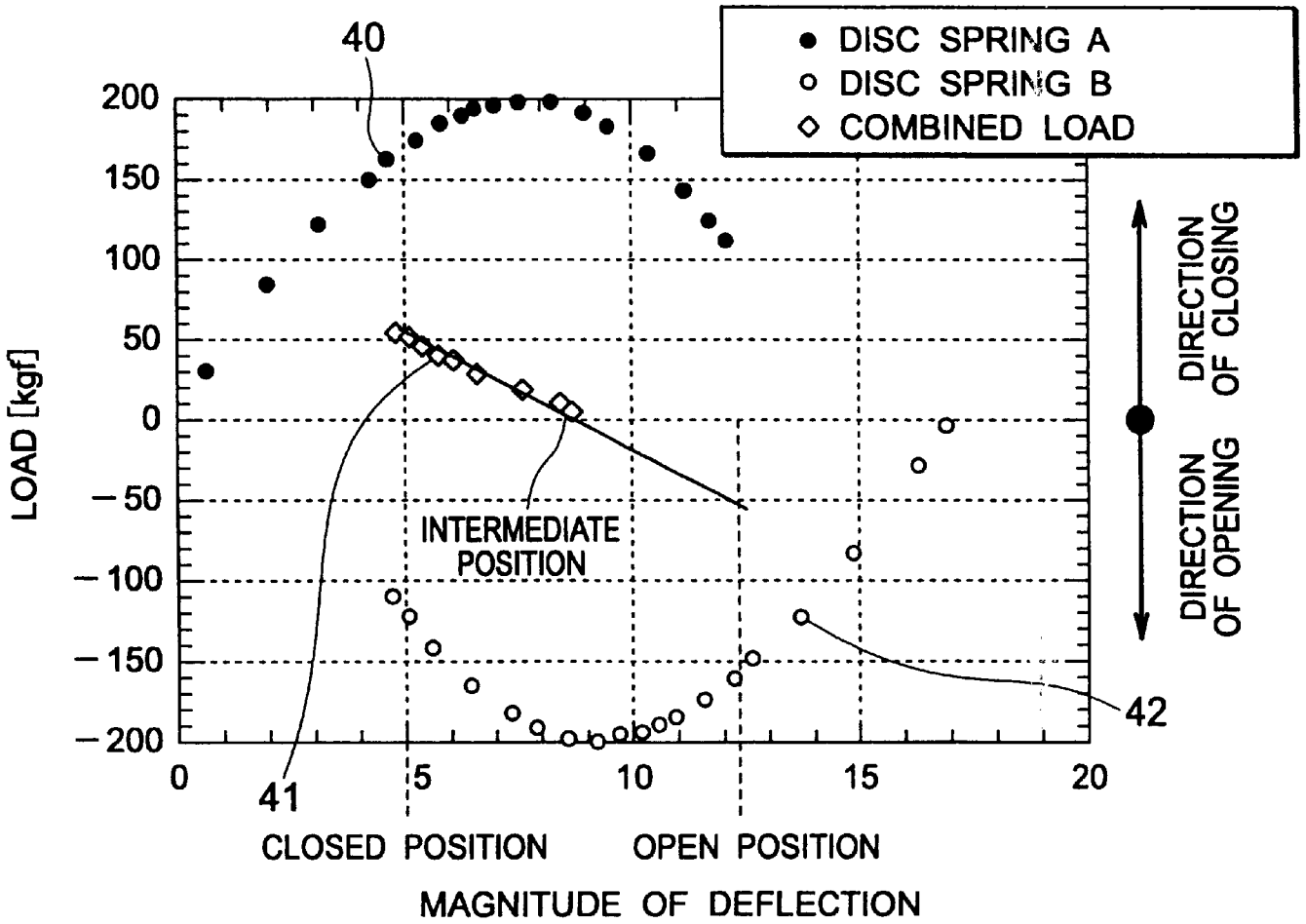
FIG. 9 PRIOR ART
FIG. 9 shows the load characteristics of pressurizing springs employed in the conventional switching apparatus.

FIGS. 1(*a*) and 1(*b*) show the structure of a switching apparatus constructed in accordance with a first embodiment of the present invention. In this figure, the switching apparatus of this embodiment includes, as in the conventional one described above, a switch 1, an opening coil 3*a*, a closing coil 3*b*, a movable shaft 4, a movable electrode 5, a stationary electrode 6, a terminal 7, a pair of pressurizing springs 8*a*, 8*b*, an auxiliary switch 9, and support members S. These components are identical to those of the conventional switching apparatus shown in FIGS. 8(*a*) and 8(*b*). In addition to these components, the switching apparatus of this embodiment further includes a movable coil 10 which is fixedly mounted on the movable shaft 4 in opposition to the opening and closing coils 3*a*, 3*b* supported by the support members S. Here, note that FIG. 1(*a*) shows a closed state of the switch 1 whereas FIG. 1(*b*) shows an open state of the switch 1.

Figure 2:
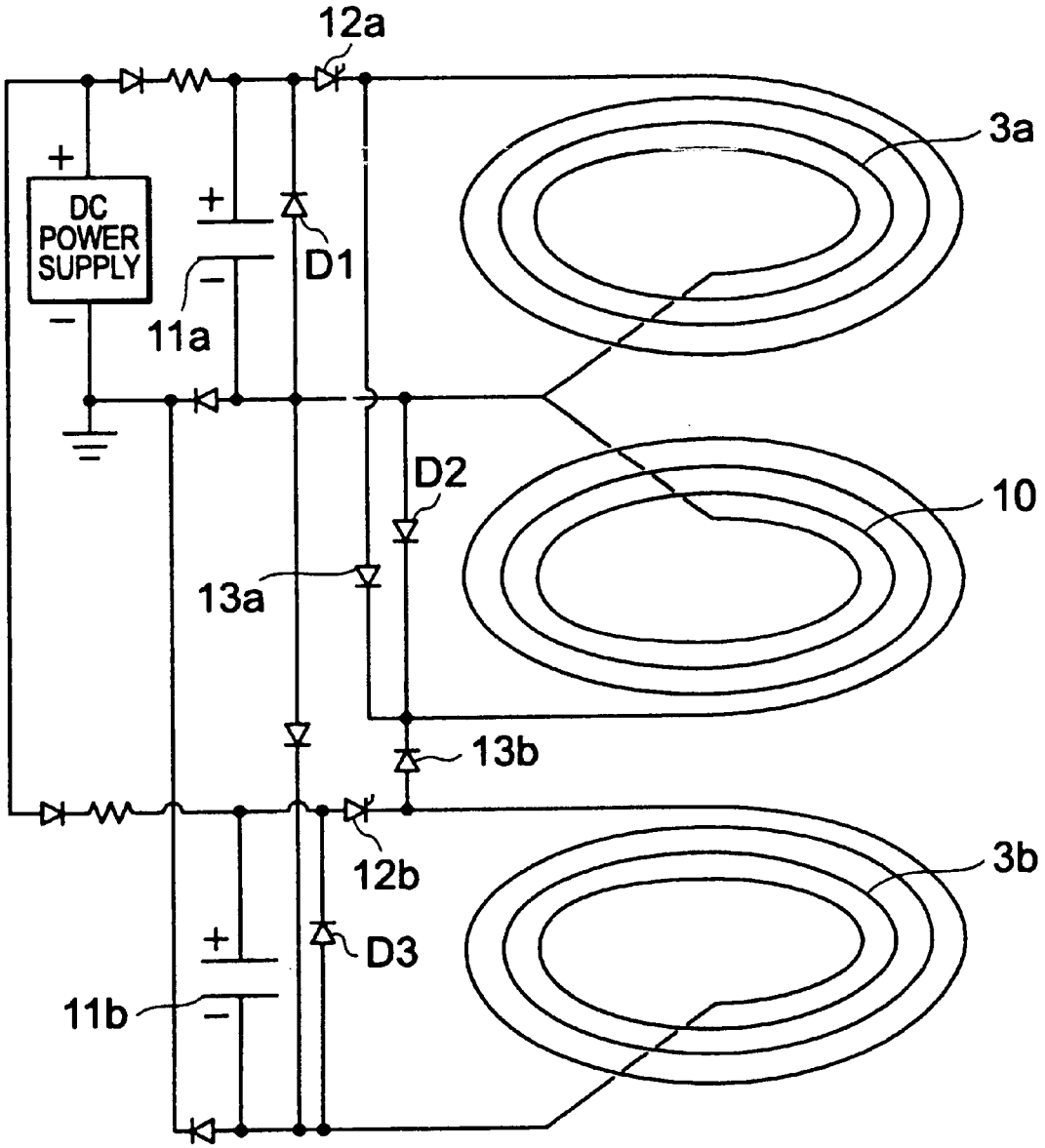
FIG. 2 shows an example of connections among an opening coil, a closing coil, a movable coil, and a power supply for supplying a pulsating current to the coils, all of which are shown in FIG. 1(*a*) and employed in the first embodiment of the present invention.

FIG. 2 shows an example of connections among the opening coil 3*a*, the closing coil 3*b*, the movable coil 10, and a power supply in the form of a DC power supply for supplying a pulsating current to the coils 3*a*, 3*b* which are shown in FIG. 1. Moreover, the switching apparatus of this embodiment further includes an opening power reservoir 11*a* in the form of a capacitor connected across the DC power supply for storing electric power or energy for opening the switch 1, a closing power reservoir 11*b* in the form of a capacitor connected across the DC power supply for storing electric power or energy for closing the switch 1, an opening discharge switch 12*a* in the form of a semiconductor device, a closing discharge switch 12*b* in the form of a semiconductor device, and inter-coil connection diodes 13*a* and 13*b*. Further, a diode D1 is connected in parallel with the opening coil 3*a* for releasing electromagnetic energy accumulated therein. Also, a diode D2 is connected in parallel with the movable coil 10 for releasing electromagnetic energy accumulated therein. A diode D3 is connected in parallel with the closing coil 3*b* for releasing electromagnetic energy accumulated therein.

The opening coil 3*a* and movable coil 10 are connected in parallel with each other. Pulsating current is supplied from the opening power reservoir 11*a* to the opening coil 3*a* and movable coil 10 via the opening discharge switch 12*a*. Moreover, the closing coil 3*b* and the movable coil 10 are connected in parallel with each other. Pulsating current is supplied from the closing power reservoir 11*b* to the closing coil 3*b* and movable coil 10 via the closing discharge switch 12*b*.

The inter-coil connection diode 13*a* is interposed between the opening discharge switch 12*a* and the movable coil 10. The inter-coil connection diode 13*b* is interposed between the closing discharge switch 12*b* and the movable coil 10. The opening power reservoir 11*a* and the closing power reservoir 11*b* each comprise a capacitor or a battery and serve to reserve power for supplying an excitation current to the coils.

Next, a description will be made of a contact separating action to be carried out by the switching apparatus of this embodiment.

Referring to FIG. 2, when the opening discharge switch 12*a* is turned on, a pulsating current flows from the opening power reservoir 11*a* to the discharge switch 12*a* and the opening coil 31, thereby generating magnetic fields.

When the opening discharge switch 12*a* is turned on, a pulsating current flows into the movable coil 10 via the inter-coil connection diode 13*a*, whereby magnetic fields are generated in a direction opposite to the direction of the magnetic fields which are induced by the opening coil 3*a*. Consequently, magnetic fields oriented in mutually opposite directions are induced by the opening coil 3*a* and the movable coil 10. The movable coil 10 undergoes electromagnetic repulsion oriented downward in the drawing sheet of FIG. 2 due to the interaction between the magnetic fields. As a result, the movable shaft 4 fixed to the movable coil 10 is pulled down, so that the movable electrode 5 and the stationary electrode 6 of the switch 1 are separated from each other, thus opening the switch 1, as shown in FIG. 1(*b*)

After the pulsating current is cut off, the electromagnetic energy accumulated in the opening coil 3*a* circulates from the opening coil 3*a* through the diode D1 to the opening discharge switch 12*a* thereby to gradually attenuate. Moreover, the electromagnetic energy accumulated in the movable coil 10 circulates through the movable coil 10 via the diode D2 thereby to gradually attenuate.

The inter-coil connection diode 13*b* is interposed between a start point of winding of the movable coil 10 and that of the closing coil 3*b*, so that a pulsating current is thereby prevented from flowing into the closing coil 3*b* and hence there is no interaction of magnetic fields induced by the closing coil 3*b* and the movable coil 10. As a result, an opening action is carried out in a reliable manner. Moreover, after the pulsating current is discharged from the opening power reservoir 11*a*, the inter-coil connection diode 13*a* prevents current from flowing out of the closing power reservoir 11*b*, thus enabling a closing action succeeding the opening action to be carried out without fail.

Next, a description will be made of a contact meeting action in accordance with this embodiment. When the closing discharge switch 12*b* is turned on, a pulsating current flows from the closing power reservoir 11*b* into the closing coil 3*b* through the closing discharge switch 12*b*.

When the closing discharge switch 12*b* is turned on, a pulsating current flows into the movable coil 10 through the inter-coil connection diode 13*b*, whereby magnetic fields are generated in a direction opposite to the direction of the magnetic fields induced by the closing coil 3*b*. Consequently, magnetic fields oriented in mutually opposite directions are induced by the opening coil 3*a* and the movable coil 10. The movable coil 10 undergoes electromagnetic repulsion oriented upward in the drawing sheet of FIG. 2 due to the interaction between the magnetic fields, so that the movable shaft 4 fixed to the movable coil 10 is pulled up, thus causing the movable electrode 5 and the stationary electrode 6 of the switch 1 to meet or contact with each other. As a result, the switch 1 is closed as shown in FIG. 1(*a*).

After the pulsating current is cut off, the electromagnetic energy accumulated in the closing coil 3*b* circulates through the closing coil 3*b* via the diode D3 and the closing discharge switch 12*b*, and hence gradually attenuates. Also, the electromagnetic energy accumulated in the movable coil 10 circulates through the movable coil 10 via the diode D2 and hence gradually attenuates.

Moreover, after the pulsating current is discharged from the closing power reservoir 11*b*, the inter-coil connection diode 13*b* prevents current from flowing out of the opening power reservoir 11*a* into the closing power reservoir 11*b*, thus enabling an opening action succeeding the closing action to be carried out without fail.

Second Embodiment

In the first embodiment described above, the inter-coil connection diode 13*b* is interposed between the start point of winding of the movable coil 10 and that of the closing coil 3*b*, for preventing a pulsating current from flowing from the closing power reservoir 11*b* into the closing coil 3*b* when the switch 1 is open. Likewise, the inter-coil connection diode 13*a* is interposed between the start point of winding of the movable coil 10 and that of the opening coil 3*a*, for preventing a pulsating current from flowing from the opening power reservoir 11*a* into the opening coil 3*a* when the switch is closed.

Figure 3:
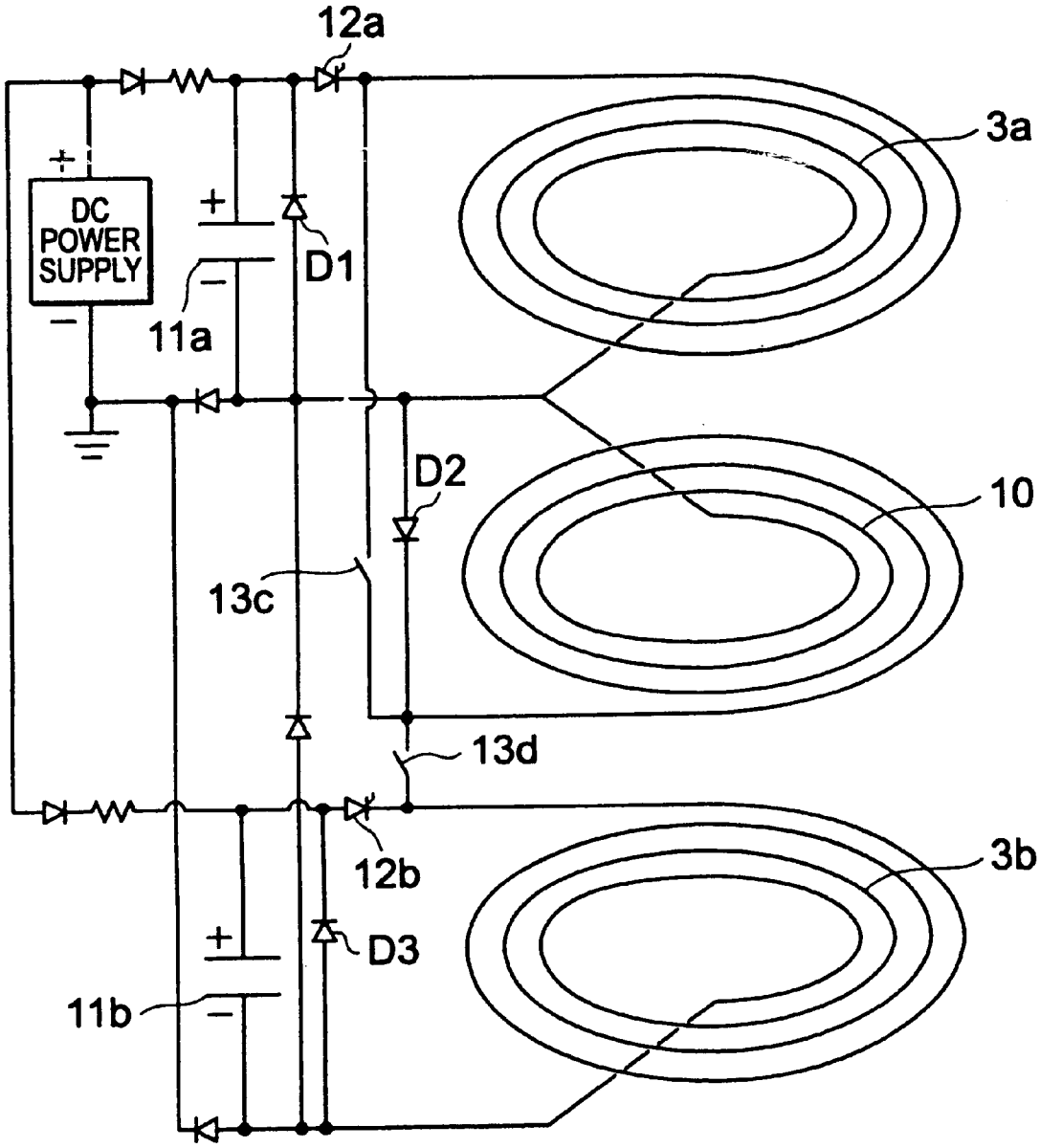
FIG. 3 shows an example of connections among an opening coil, a closing coil, a movable coil, and a power supply for supplying a pulsating current to the coils, all of which are shown in FIG. 1(*a*) but employed in a second embodiment of the present invention.

In this second embodiment, as shown in FIG. 3, inter-coil connection switches 13*c* and 13*d* are substituted for the inter-coil connection diodes 13*a* and 13*b* of the first embodiment. Owing to these components, when an opening action is carried out, the inter-coil connection switch 13*c* is turned on and the inter-coil connection switch 13 is turned off. When a closing action is carried out, the inter-coil connection switch 13*c* is turned off and the inter-coil connection switch 13 is turned on.

Owing to the inclusion of the inter-coil connection switches 13*c* and 13*d*, similar to the inclusion of the inter-coil connection diodes 13*a* and 13*b* in the first embodiment, any unnecessary current is prevented from flowing into the coils during a closing or opening action of the switch. Moreover, current can be prevented from flowing from a power reservoir, which has not been discharged, into a power reservoir that has just been discharged. The inter-coil connection switches 13*c* and 13*d* may be operatively connected with each other through the auxiliary switch 9 itself shown in FIG. 1 or through the auxiliary switch 9 and an electronic circuit associated therewith such that for an opening action, the inter-coil connection switch 13*c* is turned on and the inter-coil connection switch 13 is turned off, whereas for a closing action, the inter-coil connection switch 13*c* is turned off and the inter-coil connection switch 13 is turned on. This results in improved reliability in the switching actions.

Third Embodiment

Figure 4:
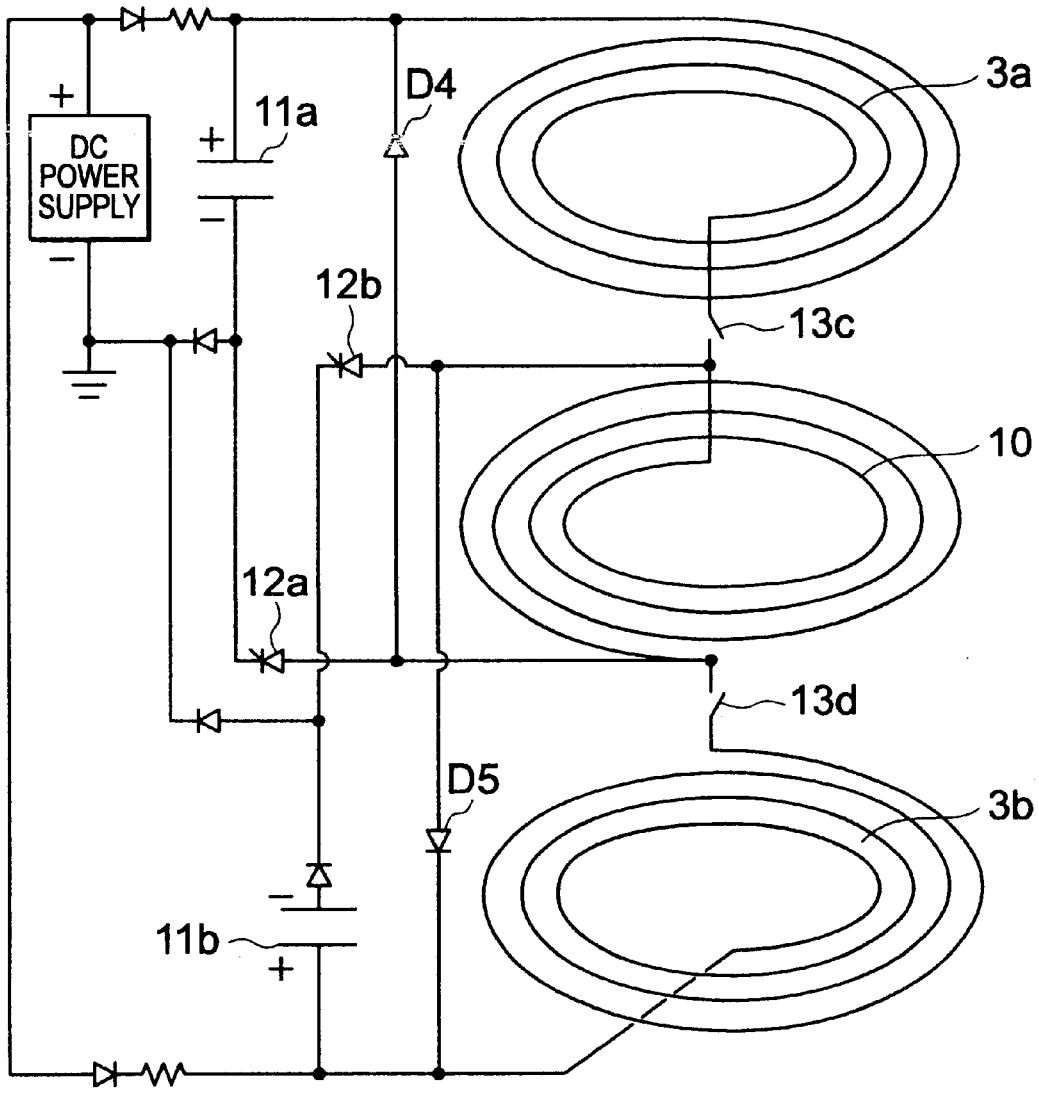
FIG. 4 shows an example of connections among an opening coil, a closing coil, a movable coil, and a power supply for supplying a pulsating current to the coils, all of which are shown in FIG. 1(*a*) but employed in a third embodiment of the present invention.

Moreover, FIG. 4 shows another example of connections among the opening coil 3*a*, the closing coil 3*b*, the movable coil 10 and the power supply for supplying a pulsating current to the coils, all of which are shown in FIG. 1, in accordance with a third embodiment of the invention. In FIG. 4, like or corresponding components of this embodiment are identified by like symbols as employed in FIGS. 2 and 3.

In this third embodiment, unlike the first and second embodiments, an opening coil 3*a* and a movable coil 10 are connected in series with each other, as shown in FIG. 4. A pulsating current is supplied from an opening power reservoir 11*a* to the opening, closing and movable coils 3*a*, 3*b* and 10 via an opening discharge switch 12*a*. Moreover, the closing coil 3*b* and the movable coil 10 are connected in series with each other. A pulsating current is supplied from a closing power reservoir 11*b* to the coils 3*a*, 3*b* and 10 via a closing discharge switch 12*b*.

An inter-coil connection switch 13*c* is interposed between the opening coil 3*a* and the movable coil 10, and an inter-coil connection switch 13*d* is interposed between the closing coil 3*b* and the movable coil 10. The inter-coil connection switches 13*c* and 13*d* may be operatively connected with each other through an auxiliary switch 9 itself shown in FIG. 1 or the auxiliary switch 9 and an electronic circuit associated therewith, thus improving the reliability of switching actions. For opening, the inter-coil connection switch 13*c* is turned on and the inter-coil connection switch 13*d* is turned off, whereas for closing, the inter-coil connection switch 13*c* is turned off and the inter-coil connection switch 13*d* is turned on.

Next a description will be made of a contact separating action in accordance with the third embodiment.

Referring to FIG. 4, when the opening discharge switch 12*a* is turned on, a pulsating current flows from the opening power reservoir 11*a* into the opening coil 3*a* and the movable coil 10, so that magnetic fields oriented in mutually opposite directions are induced by the opening coil 3*a* and the movable coil 10. Thus, the movable coil 10 undergoes electromagnetic repulsion acting downward in the drawing sheet of FIG. 4 due to the interaction between the magnetic fields. Thereafter, operations as described in detail in the related art are carried out. Consequently, the switch 1 is opened as shown in FIG. 1(*b*).

At this time, the inter-coil connection switch 13*d* is turned off and hence prevents a pulsating current from flowing into the closing coil 3*b*. As a result, electromagnetic fields induced by the closing coil 3*b* and the movable coil 10 will not interact with each other. An opening action can therefore be carried out reliably. After the supply of pulsating current is cut off, the electromagnetic energy accumulated in the opening coil 3*a* and the movable coil 10 circulates through the opening coil 3*a* and movable coil 10 via the diode D4, thus gradually attenuating.

Next, reference will be had to a contact meeting action in accordance with this third embodiment.

Referring to FIG. 4, when the closing discharge switch 12*b* is turned on, pulsating current flows from the closing power reservoir 11*b* into the closing coil 3*b* and the movable coil 10, whereby magnetic fields oriented in opposite directions are induced in the closing coil 3*b* and the movable coil 10. The movable coil 10 undergoes electromagnetic repulsion oriented upward in the drawing sheet of FIG. 4 due to the interaction between the magnetic fields. Thereafter, operations similar to those in the related art are carried out. Consequently, the switch 1 is closed as shown in FIG. 1(*a*). At this time, due to the inclusion of the inter-coil connection switch 13*c*, any pulsating current will not flow into the opening coil 3*a*. In addition, magnetic fields induced by the opening coil 3*a* and the movable coil 10 will not interact with each other. An opening action is therefore carried out reliably.

Moreover, the inter-coil connection switch 13*c* is turned off, preventing a current from flowing from the opening power reservoir 11*a* into the closing power reservoir 11*b* after a pulsating current is discharged from the closing power reservoir 11*b*. Thus, the opening action succeeding the closing action can therefore be carried out without fail. After the supply of pulsating current is cut off, electromagnetic energy accumulated in the closing coil 3*b* and the movable coil 10 circulates through the closing coil 3*b* and the movable coil 10 via the diode D5, thereby gradually attenuating.

Fourth Embodiment

Figure 5B:
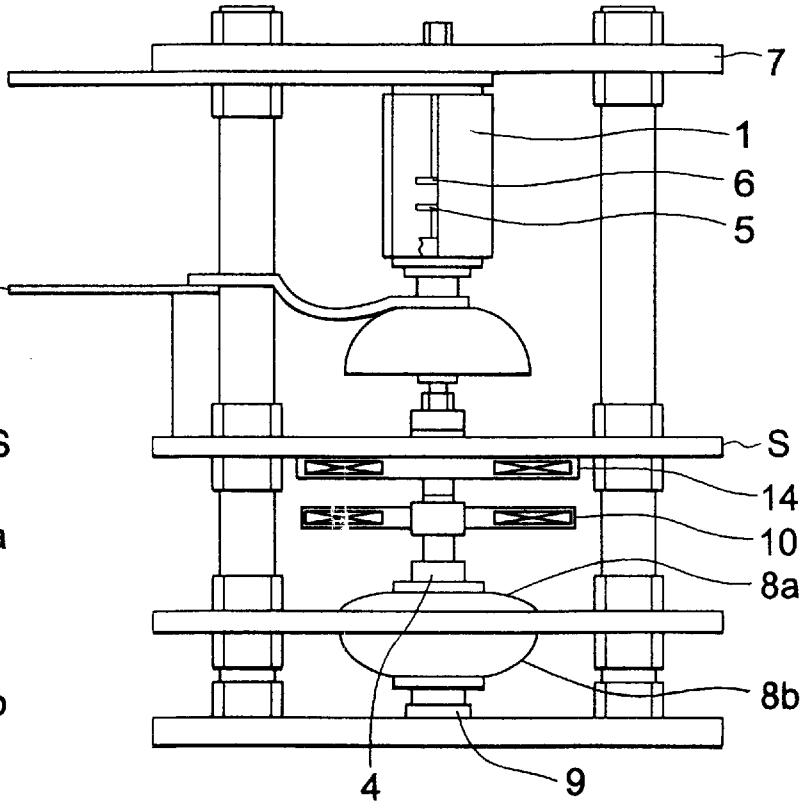
FIGS. 5(*a*) and 5(*b*) show the structure of a switching apparatus at its different operating states in accordance with a fourth embodiment of the present invention.
Figure 5A:
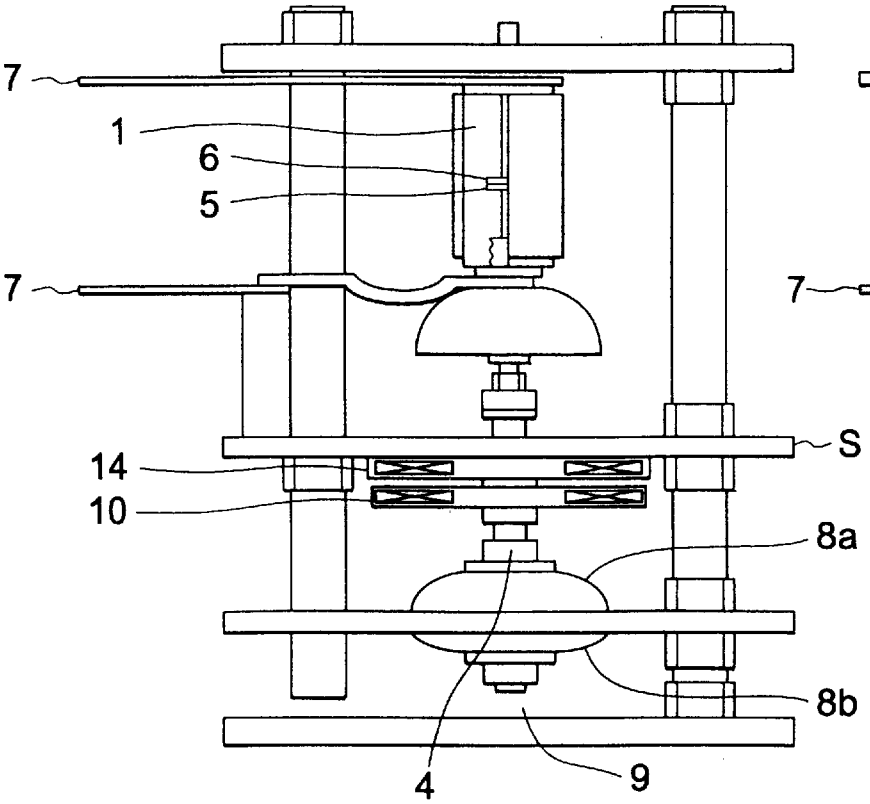

In the aforesaid embodiments, the opening coil 3*a* and closing coil 3*b* are placed on and under the movable electrode 5 with the movable shaft 4 passed through the coils. In contrast, a switching apparatus according to a fourth embodiment includes a stationary coil and a movable coil undergoing an interaction between magnetic fields. FIG. 5 shows the structure of the switching apparatus of the fourth embodiment of the present invention. In this figure, the switching apparatus of this embodiment includes a switch 1, a movable shaft 4, a movable electrode 5, a stationary electrode 6, a terminal 7, pressurizing springs 8*a*, 8*b*, an auxiliary switch 9 and a movable coil 10, as in FIG. 1 of the first embodiment. These components are identical to those of the first embodiment. Moreover, a stationary coil 14 is fixedly mounted on support members S, which are in turn fixedly secured to a frame structure, in an opposed relation to the movable coil 10. FIG. 5(*a*) shows the closed state of the switch 1, whereas FIG. 5(*b*) shows the open state of the switch 1.

Figure 6:
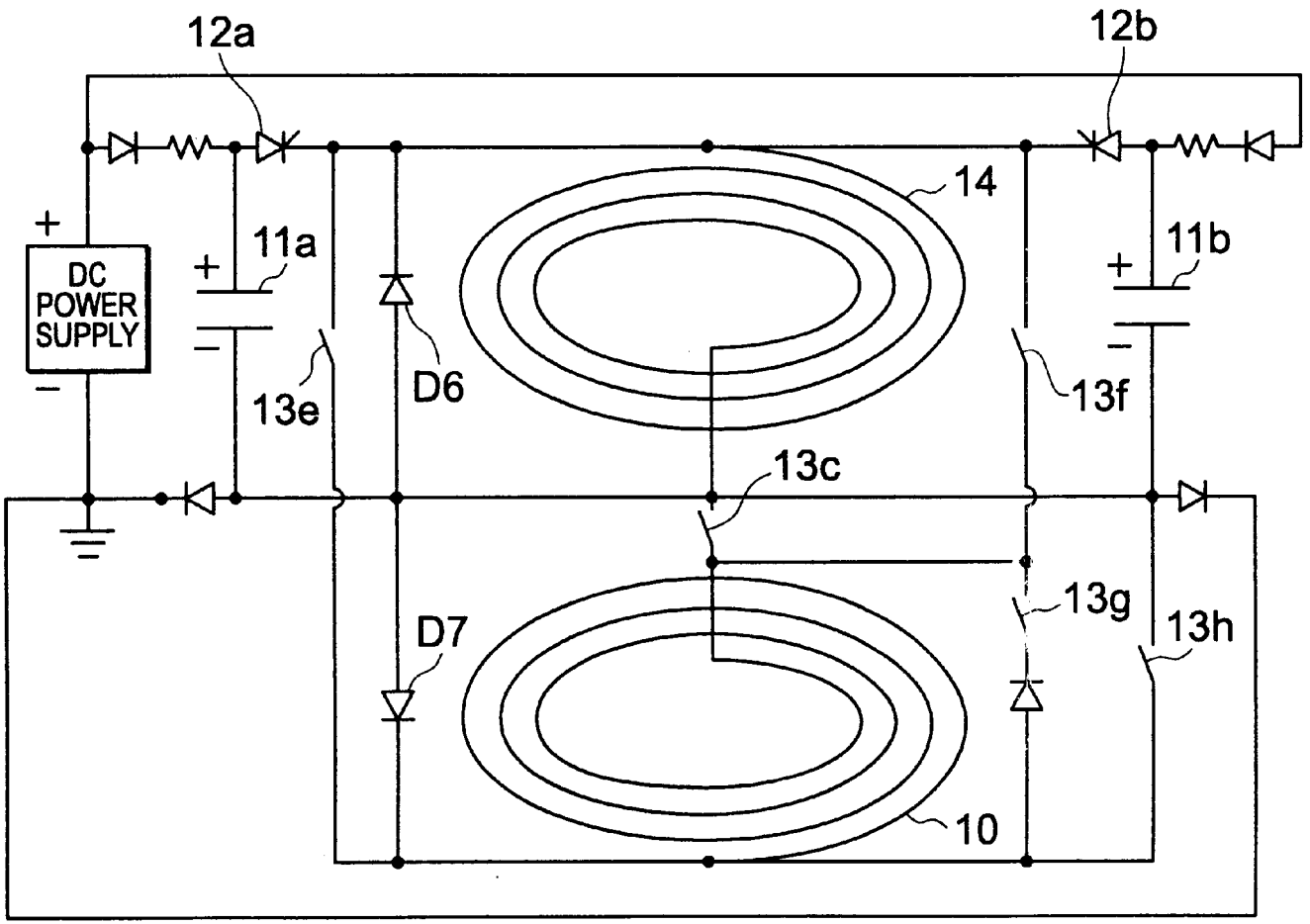
FIG. 6 shows an example of connections among a movable coil, a stationary coil, and a power supply for supplying a pulsating current to the coils, all of which are shown in FIG. 5(*a*) and employed in the fourth embodiment of the present invention.

FIG. 6 shows an example of an electric circuit of the switching apparatus of FIG. 5, among the movable coil 10, the stationary coil 14 and the power supply for supplying pulsating current to the coils.

In FIG. 6, the movable coil 10 and the stationary coil 14 are connected in parallel with each other. A pulsating current is supplied from an opening power reservoir 11*a* and a closing power reservoir 11*b* to the coils 10, 14 via an opening discharge switch 12*a*. An inter-coil connection switch 13*c* is interposed between a negative electrode of the opening power reservoir 11*a* and the movable coil 10 via the opening discharge switch 12*a*. A switch 13*e* is connected at one end to a terminating end of the movable coil 10 and at the other end to a terminating end of the stationary coil 14. A pair of serially connected switches 13*f*, 13*g* are connected at one end to the terminating end of the stationary coil 14 and at the other end to the terminating end of the movable coil 10 with their interconnection point coupled to one end of the inter-coil connection switch 13*c*. A switch 13*h* is also connected at one end to a negative electrode of the closing power reservoir 11*b* and at the other end to the terminating end of the movable coil 10. A pair of serially connected diodes D6, D7 are connected at one end to the terminating end of the movable coil 10 and at the other end to the terminating end of the stationary coil 14 in parallel with the switch 13*e* with their interconnection point being coupled to the other end of the inter-coil connection switch 13*c*.

Moreover, for an opening action, the inter-coil connection switch 13*c* and the switches 13*e* through 13*h* are turned off. For a closing action, the inter-coil connection switch 13*c* and the switch 13*e* are turned off, and the switches 13*f* through 13*h* are turned on. The inter-coil connection switch 13*c* and the switches 13*e* through 13*h* may be operatively connected with one another by the auxiliary switch 9 itself shown in FIG. 5 or the auxiliary switch 9 and an electronic circuit-associated therewith. In this case, similar to the aforesaid embodiments, the reliability of switching would be improved.

Next, a description will be made of a contact separating action in accordance with this fourth embodiment.

Referring to FIG. 6, when the discharge switch 12*a* is turned on, a pulsating current flows from the opening power reservoir 11*a* into the stationary coil 14 and the movable coil 10 through the inter-coil connection switch 13*c* so that magnetic fields oriented in mutually opposite directions are induced by the stationary coil 14 and the movable coil 10. Thus, the movable coil 10 undergoes electromagnetic repulsion oriented downward in the drawing sheet of FIG. 6 due to the interaction with magnetic fields induced by the stationary coil 14. Consequently, the drive shaft 4 is pulled down. Thereafter, operations as in the related art described before are carried out so that the switch 1 is eventually opened as shown in FIG. 5(*b*).

At this time, the inter-coil connection switch 13*c* and switch 13*e* are turned on, and the switches 13*f* through 13*h* are turned off. Thus, a pulsating current flows into the stationary coil 14 and the movable coil 10 so that magnetic fields oriented in mutually opposite directions will be induced by the coils 14, 10. After the pulsating current supplied from the opening power reservoir 11*a* is cut off, the electromagnetic energy accumulated in the stationary coil 14 circulates through the coil 14 via the diode D6 connected in parallel with the stationary coil 14, thus gradually attenuating the electromagnetic energy. Moreover, the electromagnetic energy accumulated in the movable coil 10 circulates through the coil 10 via the diode D7 connected in parallel with the coil 10, further reducing the electromagnetic energy gradually.

Next, a description will be made of a contact meeting action in accordance with the fourth embodiment.

Referring to FIG. 6, when the closing discharge switch 12*b* is turned on, a pulsating current flows from the closing power reservoir 11*b* into the stationary coil 14 and the movable coil 10 through the switches 13*f* through 13*h*, whereby magnetic fields oriented in mutually opposite directions are induced by the stationary coil 14 and the movable coil 10. As a result, the stationary coil 14 is subjected to an electromagnetic attraction oriented upward in the drawing sheet of FIG. 6 due to its interaction with magnetic fields induced by the movable coil 10. The movable coil 10 is then attracted by the stationary coil 14, and pulls up the drive shaft 4.

Thereafter, operations as in the related art described before are carried out, thus eventually closing the switch 1 as shown in FIG. 5(*a*). At this time, the inter-coil connection switch 13*c* and the switch 13*e* are both turned off, and the switch 13*f* through 13*h* are turned on. Consequently, it is ensured that a pulsating current flows into the stationary coil 14 and the coil 10, causing magnetic fields oriented in mutually opposite directions to be induced by the coils. After the pulsating current supplied from the opening power reservoir 11*b* is cut off, the electromagnetic energy accumulated in the stationary coil 14 circulates through the coil 14 via the diode D6 connected in parallel with the coil 14, thus gradually attenuating. Also, the electromagnetic energy accumulated in the movable coil 10 circulates through the coil 10 via a diode D8 connected in parallel with the coil 10, and hence gradually attenuates.

Fifth Embodiment

Figure 7B:
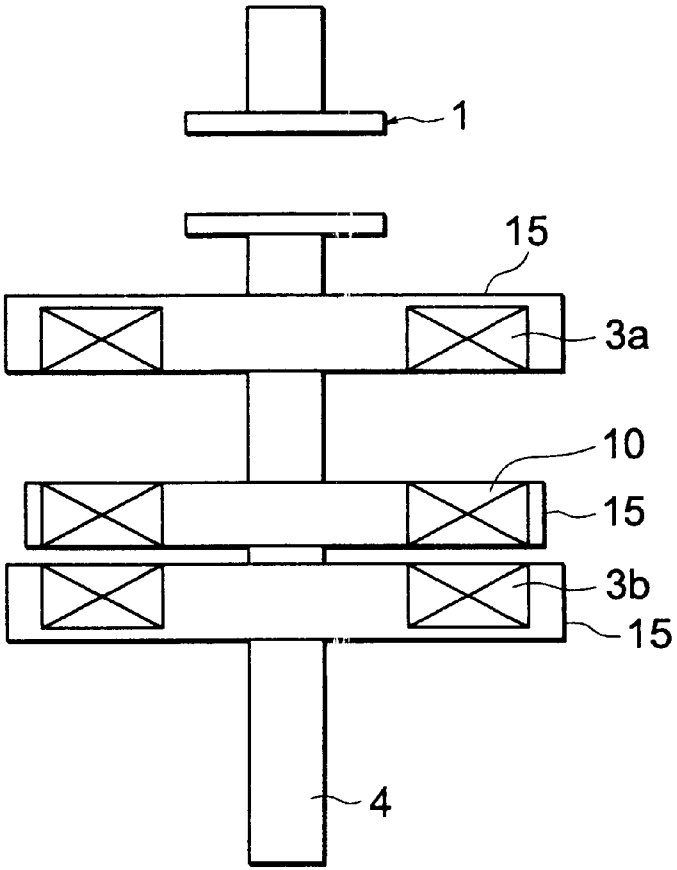
FIGS. 7(*a*) and 7(*b*) schematically show a switching apparatus at its different operating states in accordance with a fifth embodiment of the present invention.
Figure 7A:
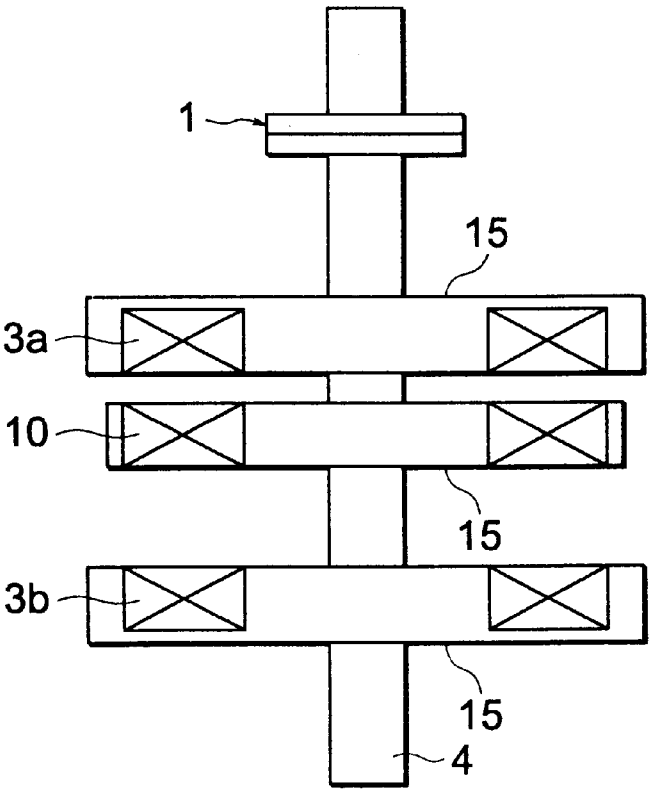

FIGS. 7(*a*) and 7(*b*) schematically illustrate essential portions of a switching apparatus at its different operating states constructed in accordance with a fifth embodiment of the present invention which is an improvement of the switching apparatus according to the first embodiment of the present invention. In these figures, the switching apparatus of this embodiment comprises a switch 1, an opening coil 3*a*, a closing coil 3*b* disposed in an opposed parallel relation with respect to the opening coil 3*a*, a movable shaft 4 extending through the opening and closing coils 3*a*, 3*b*, and a movable coil 10 disposed between the opening and closing coils 3*a*, 4*b* and fixedly mounted on the movable shaft 4 for movement toward and away from them in accordance with axial displacement of the movable shaft 4, as in the first embodiment. Moreover, a magnetic substance 15 in the form of a paramagnetic substance or ferromagnetic substance is placed to cover the outer circumferences of the cores of the opening, closing and movable coil 3*a*, 3*b*, 10. This placement serves to make induced magnetic fields stronger. As a consequence, a power supply for supplying a pulsating current to the opening coil 3*a*, closing coil 3*b* and movable coil 10 is required to have only a smaller capacity as compared with the first embodiment. In addition, needless to say, the placement will prove effective in the other embodiments.

As described above, according to the present invention, a switching apparatus is provided which comprises a switch unit, a movable coil, a stationary coil, a power supply, and a direction-of-conduction setter. The switch unit is composed of a stationary electrode and a movable electrode that is movable toward and away from the stationary electrode. The movable coil is fixedly mounted on a movable shaft coupled to the movable electrode. The stationary coil is disposed in opposition to the movable coil. The power supply supplies excitation current to the coils. The direction-of-conduction setter serves to set the direction of conduction, in which an excitation current flows from the power supply into the coils, in such a manner that magnetic fields induced by the coils will interact with each other. Current is supplied directly to the two stationary and movable coils. This leads to highly efficient electromagnetic driving. Moreover, there is an advantage that an opening power supply or closing power supply is required to have only a small capacity.

Moreover, the stationary coil comprises a first stationary coil and a second stationary coil disposed in opposition to each other above and below the movable coil. When the switch unit is opened, an excitation current flows from the power supply into the movable coil and the first stationary coil. At this time, the direction-of-conduction setter sets the direction of conduction, in which the excitation current flows from the power supply into the coils, so that magnetic repulsion will occur between the movable coil and the first stationary coil. When the switch unit is closed, an excitation current flows into the movable coil and the second stationary coil. At this time, the direction-of-conduction setting means sets a direction of conduction, in which the excitation current flows from the power supply into the coils, so that magnetic repulsion will occur between the movable coil and the second stationary coil. This exerts such an advantage that magnetic fields can be induced efficiently by the coils and electromagnetic repulsion can be generated efficiently due to the interaction between the magnetic fields inducted thereby.

Furthermore, provisions are made for a first inhibiter for inhibiting the inflow of current to a second stationary coil when the first stationary coil and the movable coil are supplied with a current from the power supply, and a second inhibitter for inhibiting the inflow of current to the first stationary coil when the second stationary coil and the movable coil are supplied with a current from the power supply. This arrangement provides an advantage that the inflow of current to a coil which need not operate can be suppressed, eventually improving the reliability of switching actions.

In addition, when the switch unit is opened, an excitation current flows from the power supply into the stationary coil and the movable coil. At this time, the direction-of-conduction setter sets the direction of conduction, in which the excitation current flows from the power supply into the coils, so that magnetic repulsion will occur between the movable coil and the stationary coil. When the switch unit is closed, an excitation current flows into the movable coil and the stationary coil. At this time, the direction-of-conduction setter sets the direction of conduction, in which the excitation current flows from the power supply into the coils, so that magnetic attraction will occur between the movable coil and the stationary coil. This arrangement provides an advantage that the number of operating coils can be decreased and the whole appartus can be designed compactly.

Further, the stationary coils and he movable coil are covered with a magnetic substance so as to generate stronger magnetic fields. This provides an advantage that the opening or closing power supply is required to have only a small capacity.

What is claimed is:

1. A switching apparatus comprising:

a switch unit having a stationary electrode and a movable electrode movable toward said stationary electrode and contacting said stationary electrode in a closed state of said switch unit, and movable away from said stationary electrode and not in contact with said stationary electrode in an open state of said switch unit;

a movable coil fixedly mounted on a movable shaft coupled to said movable electrode;

a stationary coil disposed opposite said movable coil and comprising a first stationary coil member and a second stationary coil member disposed opposite each other on opposite sides of said movable coil, wherein to switch said switch unit from the closed state to the open state, said first switch is closed so that an excitation current flows through said first stationary coil member and through said first current flow control means into said movable coil to produce magnetic repulsion between said movable coil and said first stationary coil member, and to switch said switch unit from the open state to the closed state, the second switch is closed so that an excitation current flows through said second stationary coil member and through said second current flow control means into said movable coil to produce magnetic repulsion between said movable coil and said second stationary coil member;

a power supply for supplying an excitation current to said stationary and movable coils to move said movable coil toward said stationary coil to switch said switch unit from the open state to the closed state, and to move said movable coil away from said stationary coil to switch said switch unit from the closed state to the open state;

first and second switches selectively closable for selecting between opposite directions of flow of the excitation current from said power supply to said stationary and moveable coils so that magnetic fields are produced by said stationary and movable coils that interact with each other to switch said switch unit between the open and closed states; and third and fourth switches respectively connected to said first and second switches for limiting flow of the excitation current to said stationary and movable coils in switching said switch unit between the open and closed states, said third switch being closed and said fourth switch being open when said first switch is closed and said switch unit is switched from the closed state to the open state, and said third switch being open and said fourth switch being closed when said second switch is closed and said switch unit is switched from the open state to the closed stated.

2. The switching apparatus according to claim 1, wherein said stationary coil and said movable coil are covered with a magnetic material.

3. A switching apparatus comprising:

a switch unit having a stationary electrode and a movable electrode movable toward said stationary electrode and contacting said stationary electrode in a closed state of said switch unit, and movable away from said stationary electrode and not in contact with said stationary electrode in an open state of said switch unit;

a movable coil fixedly mounted on a movable shaft coupled to said movable electrode;

a stationary coil disposed opposite said movable coil;

a power supply for supplying an excitation current to said stationary and movable coils to move said movable coil toward said stationary coil to switch said switch unit from the open state to the closed state, and to move said movable coil away from said stationary coil to switch said switch unit from the closed state to the open state;

first and second switches selectively closable for selecting between opposite directions of flow of the excitation current from said power supply to said stationary and moveable coils so that magnetic fields are produced by said stationary and movable coils that interact with each other to switch said switch unit between the open and closed states; and first and second current flow control means respectively connected to said first and second switches for limiting flow of the excitation current to said stationary and movable coils in switching said switch unit between the open and closed states, wherein said first and second current flow control means comprise switches actuated in coordination with said first and second switches so that when said first switch is closed, the excitation current flows through said movable coil and said stationary coil to generate mutually repulsive magnetic fields for switching said switch unit from the closed state to the open state, and when said second switch is closed, the excitation current flows through said movable coil and said stationary coil to generate mutually attractive magnetic fields to switch said switch unit from the open state to the closed state.

4. The switching apparatus according to claim 3 wherein said first current flow control means comprises a third switch connecting said first switch to a first end of said movable coil and a fourth switch connecting a second end of said movable coil to a first end of said stationary coil, and said second current flow control means comprises a fifth switch connecting a second end of said stationary coil to the second end of said movable coil, a sixth switch connecting the first and second ends of said movable coil, and a seventh switch connecting the first end of said stationary coil to the first end of said movable coil.

5. The switching apparatus according to claim 4 wherein said first current flow control means is closed and said second current flow control means is open when said switch unit is switched from the closed state to the open state, and said first current flow control mean is open and said second current flow control means is closed when said switch unit is switched from the open state to the closed state.

6. The switching apparatus according to claim 3 wherein said first current flow control means is closed and said second current flow control means is open when said switch unit is switched from the closed state to the open state, and said first current flow control mean is open and said second current flow control means is closed when said switch unit is switched from the open state to the closed state.

7. The switching apparatus according to claim 3, wherein said stationary coil and said movable coil are covered with a magnetic material.

* * * * *